United States Patent [19]

Krizan

[11] 4,062,302

[45] Dec. 13, 1977

[54] SHELVING ASSEMBLY WITH REMOVABLE DIVIDER INSERTS

[75] Inventor: Bradford J. Krizan, Plymouth, Minn.

[73] Assignee: Safco Products Co., Minneapolis, Minn.

[21] Appl. No.: 750,825

[22] Filed: Dec. 15, 1976

[51] Int. Cl.[2] ..... A47B 35/00

[52] U.S. Cl. ..... 108/60; 211/135

[58] Field of Search ..... 108/60, 61; 206/44 R; 211/10, 11, 135, 184, 189; 248/174

[56] References Cited

U.S. PATENT DOCUMENTS

| | | | |
|---|---|---|---|
| 1,323,560 | 12/1919 | van Doorn | 108/60 |
| 3,107,012 | 10/1963 | Rothenborg | 211/11 |
| 3,583,783 | 6/1971 | Murphy et al. | 206/44 R X |
| 3,999,662 | 12/1976 | Barnhardt | 248/174 X |

*Primary Examiner*—James C. Mitchell

*Attorney, Agent, or Firm*—Williamson, Bains, Moore & Hansen

[57] ABSTRACT

A shelf and divider assembly comprising a rigid shelf unit with a plurality of shelves includes removable and collapsible fiberboard inserts which partition the shelf spaces laterally and vertically and which lock in place behind the corner posts of the shelf unit.

A literature storage fiberboard insert is removably installed between rigid shelves by downward and inward folding of end locking segments on horizontal shelf panels to positions wherein the locking segments clear the corner posts of the shelf unit. After the fiberboard insert is in place between shelves, the end locking segments are folded outwardly to their normal positions of use wherein they extend behind the front corner posts.

A fiberboard insert having vertical dividers for lateral filing is removably installed between rigid shelves by moving dividers on opposite ends of the insert into locking positions behind the corner posts of the shelf unit after the insert has been placed between rigid shelves.

10 Claims, 11 Drawing Figures

SHELVING ASSEMBLY WITH REMOVABLE DIVIDER INSERTS

BRIEF SUMMARY OF THE INVENTION

The shelf assembly of this invention is particularly characterized by the combination of collapsible fiberboard inserts with rigid shelving units in such a way that the fiberboard inserts are removably locked in place between shelves by fiberboard locking segments.

This basic ojective is realized by utilizing divider unit inserts of fiberboard cut, scored and formed in such a way as to provide fiberboard partitions at each end of a divider unit having locking segments which are movable between locking positions behind shelf unit corner posts and release positions permitting the divider units to clear the corner posts and be freely inserted between and removed from rigid shelves without interference with the corner posts.

One form of divider unit insert primarily intended for literature storage and incorporating horizontal shelf panel partitions has locking segments comprising scored end segments on the opposite ends of the shelf panels which can be folded inwardly and downwardly to release or non-locking positions wherein they clear the corner posts of a rigid shelving unit for insertion therebetween. After the insert is moved into place between rigid shelves, the locking segments are folded outwardly and upwardly to locking positions behind corner posts. Preferably, the end locking segments include foldable end support flaps which are folded out to substantially vertical positions one on top of the other and on top of a rigid shelf to support the aforesaid locking segments in substantially horizontal locking positions.

Another form of divider unit insert incorporates a plurality of laterally spaced, vertical partitions for lateral filing. At least the end partitions are releasably secured in place to top and bottom panels of a U-shaped fiberboard shell open at its front end and include as locking segments horizontally projecting flange strips which extend behind the corner posts of the shelf unit in their locking positions. Lock flaps on the front edges of the top and bottom panels of the insert shell normally secure the end partitions to the shell, and are foldable to open positions wherein the end partitions are released and may be moved inwardly along the length of the fixed shelves to non-locking positions wherein they clear the end posts.

Advantageously, displacement of the fiberboard inserts out of the rear side of the open-faced shelf units can be prevented by lock tabs which project upwardly from the top, rear side of the insert units and restrainably engage the inside face of a depending contact flange on the rear edge of the rigid shelves between which the fiberboard inserts are installed.

These and other objects and advantages of this invention will become readily apparent as the following description is read in conjunction with the accompanying drawings wherein like reference numerals are used to designate like elements throughout the several views.

DESCRIPTION OF THE PREFERRED EMBODIMENTS

Figure 1:
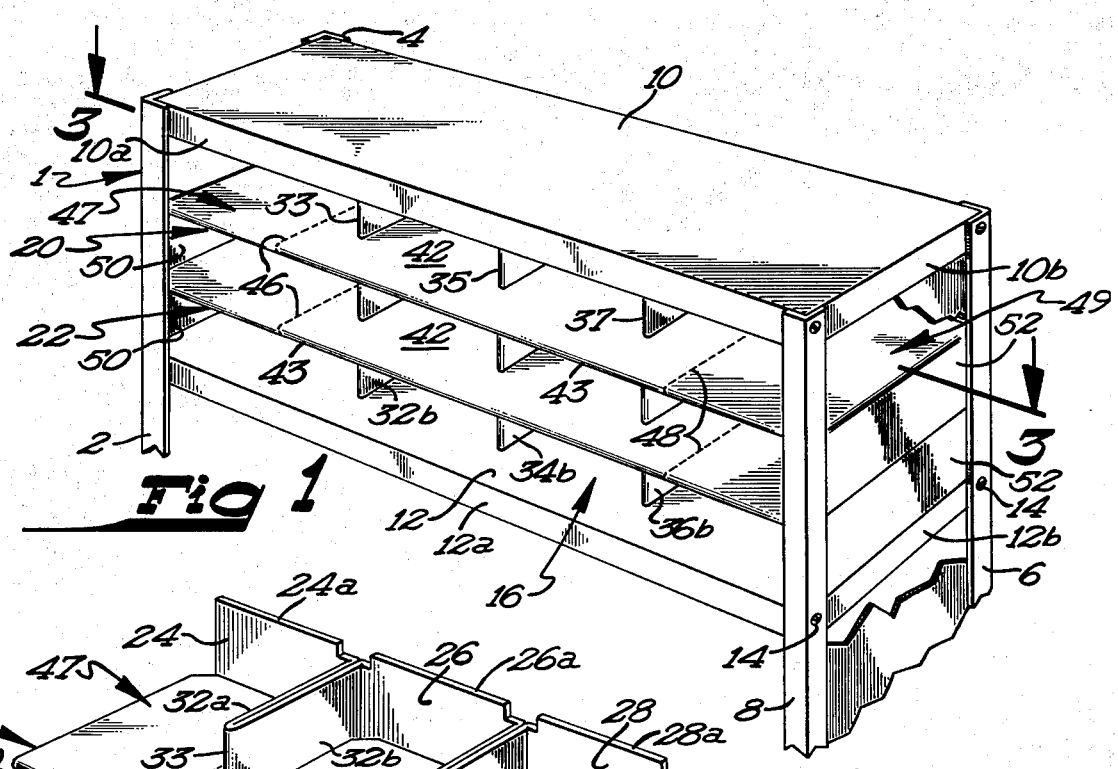
FIG. 1 is a front, perspective view of a shelf unit incorporating one of the fiberboard divider inserts of this invention.

FIG. 1 illustrates one of the preferred forms of fiberboard divider inserts of this invention assembled in combination with a rigid shelf unit. The shelf unit is preferably comprised of rigid, upright end supports between which rigid shelves are removably secured. The end support means advantageously comprise four upright corner posts 2, 4, 6 and 8. These corner posts are of the right angle configuration shown, with the vertically extending front flanges of the front corner posts 2 and 8 projecting inwardly across the front face of the shelf unit beyond the end extremities thereof. Two rigid shelves 10 and 12 are shown secured in place in vertically spaced relation between the end posts. Both the shelves 10, 12 and the posts 2–8 are preferably formed from steel and shipped in knocked down condition with removable fasteners 14 being utilized to attach these components together. Although only two shelves have been shown, it is of course anticipated that any number of shelves may be utilized to create a shelf assembly of the desired height and storage capacity. Each of the shelves has downwardly depending flanges extending around its entire periphery, the side and end flanges of the shelves visible in FIG. 1 being designated **10*a*, 10*b* and 12*a*, 12*b* respectively. Each of the shelves also include a rear side flange, this flange of shelf 10 being indicated by reference numeral 10*c* in FIG. 4**.

Figure 2:
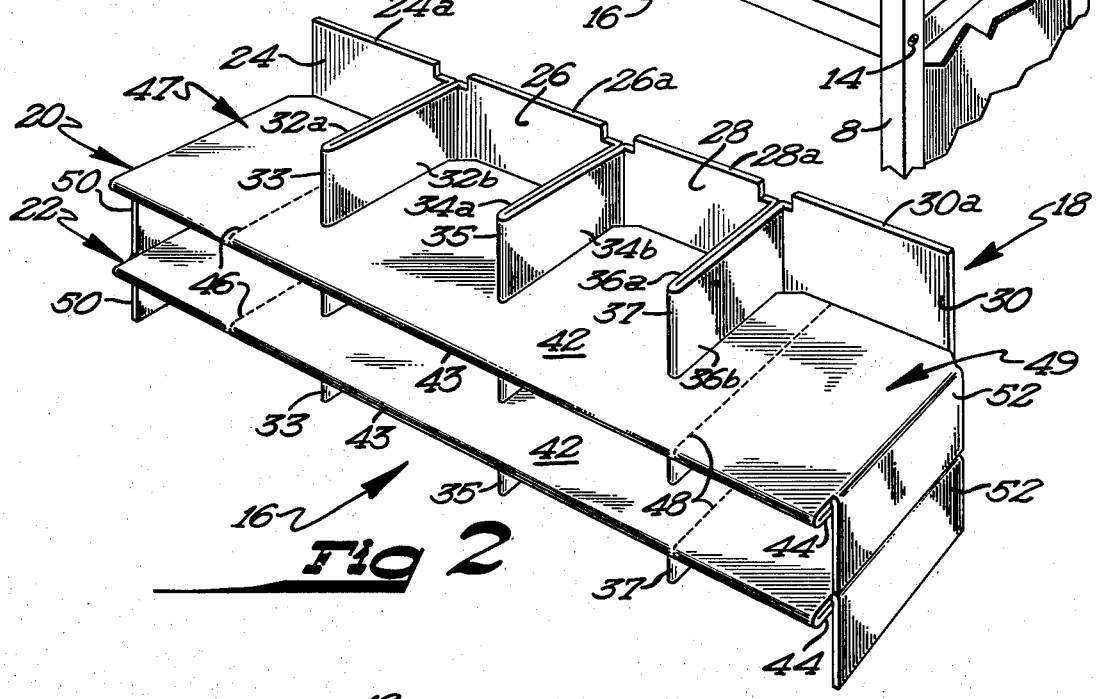
FIG. 2 is a front, perspective view of the divider insert of FIG. 1 in its fully assembled position of use.
Figure 3:
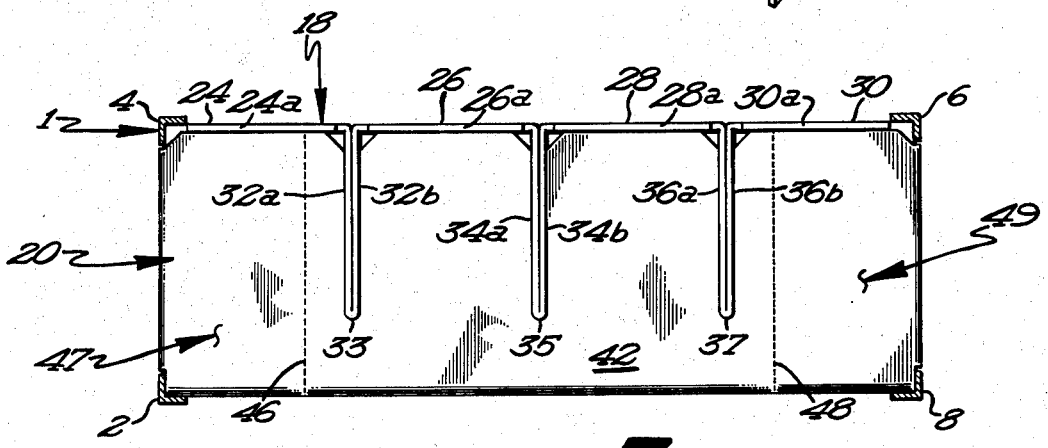
FIG. 3 is a horizontal section view of the shelf and insert assembly of FIG. 1 taken along lines 3—3 thereof.
Figure 5:
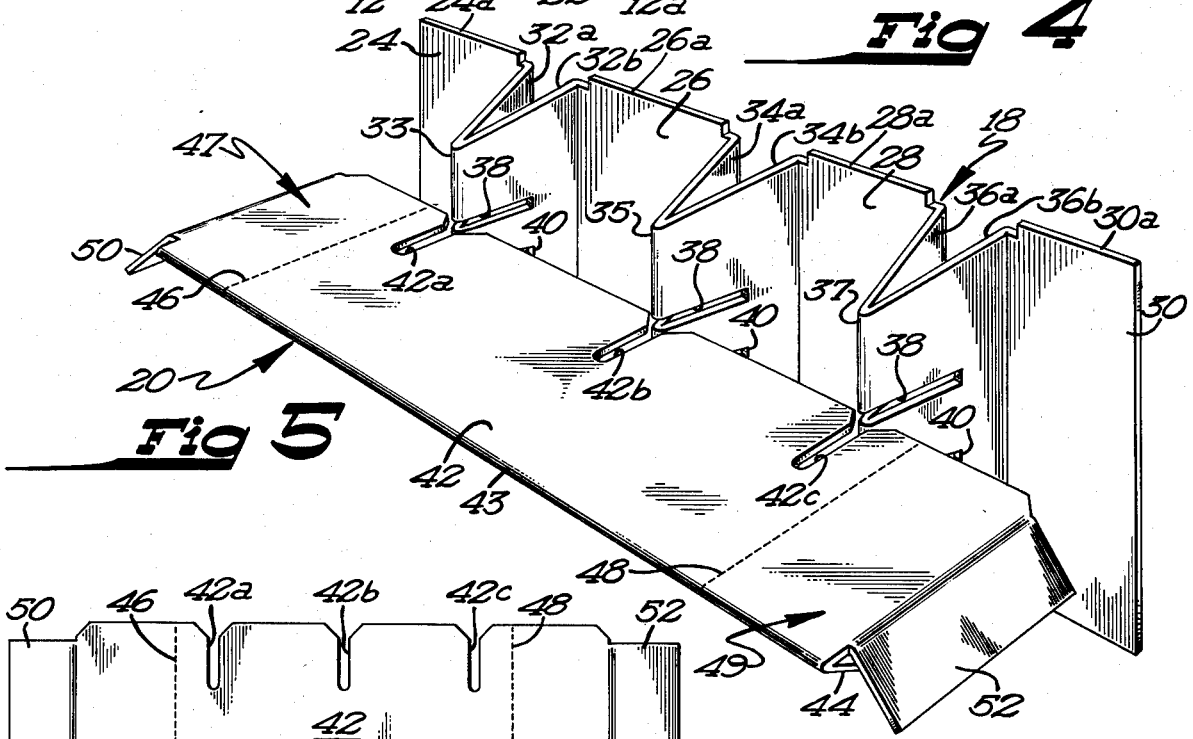
FIG. 5 is an exploded, perspective view showing the divider insert of FIG. 1 in an intermediate stage of assembly.
Figure 6:
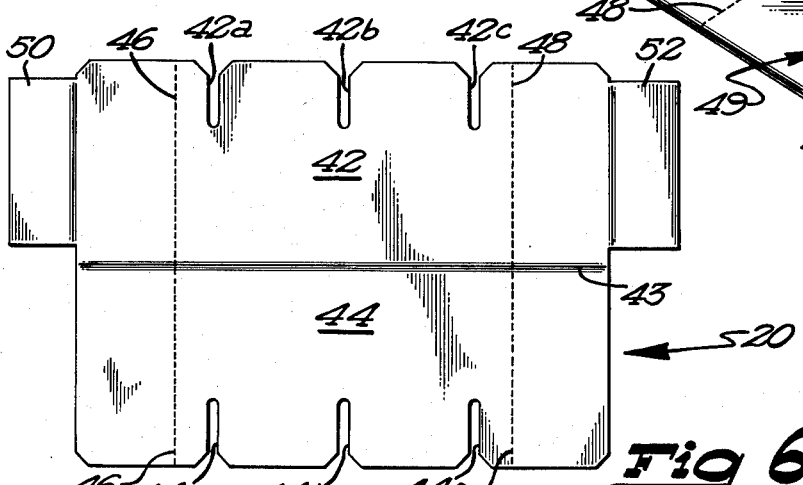
FIG. 6 is a top, plan view of the fiberboard blank from which the horizontal shelf panels of the divider insert of FIGS. 1–5 are made.
Figure 7:
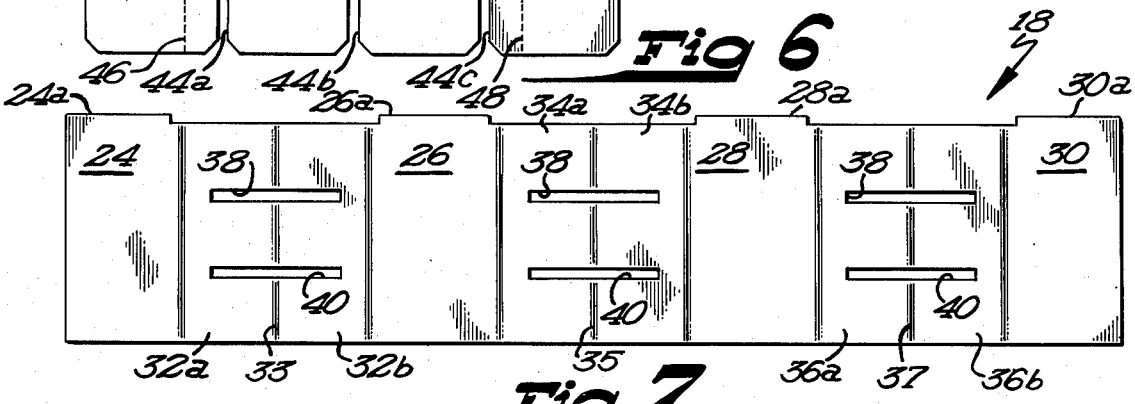
FIG. 7 is a top, plan view of the cut and scored fiberboard blank from which is formed the upright support panel for the horizontal shelf panels of the divider insert of FIGS. 1–6.

FIGS. 2–7 illustrate one form of a preferred fiberboard divider insert. This divider unit is generally indicated by reference numeral 16, and is comprised of three basic components cut, scored and assembled to provide a compartmentalized unit particularly suitable for literature storage. These components include an upright backing and shelf support panel 18, and a pair of fiberboard partitions restrainably engaged therewith in the form of vertically spaced, horizontal shelf panels 20 and 22. The upright support panel 18 is formed from a single blank of cut and scored fiberboard material as illustrated in FIG. 7. This panel includes a plurality of vertical backing panel segments 24, 26, 28 and 30 separated by scored fold lines as shown from shelf support segments 32*a*, 32*b*, 34*a*, 34*b* and 36*a*, 36*b*. These shelf support segments are folded in the manner indicated in their intermediate fold positions of FIG. 5 to final fold positions abutting face to face with each other as shown in FIGS. 2 and 3. The aforesaid pairs of shelf support segments are folded along their respective fold lines 33, 35 and 37. In their final, folded positions of use the shelf support segments 32*a*, 32*b*, 34*a*, 34*b* and 36*a*, 36*b* are oriented vertically, substantially at right angles to upright backing panel 18. It is to be noted that each of the vertical backing panel segments 24, 26, 28 and 30 incorporate at its upper end a lock tab which projects vertically above the upper edge of the adjoining shelf support segments. These lock tabs secure the entire divider unit 16 against displacement out of the rear side of the shelf unit 1, in a manner hereinafter set forth.

Elongated slots 38 and 40 are cut in the shelf support segments of upright backing panel 18 at vertically spaced locations thereon as shown in FIG. 7. Each of these slots extends across the fold lines 33, 35 and 37 and over a portion of the width of the adjoining support segments 32*a*, 32*b*, 34*a*, 34*b* and 36*a*, 36*b*. When these segments as folded together in face to face relation to the use position shown in FIGS. 2 and 3, the slots 38, 40 extend horizontally from the front edges of the folded shelf support segments as defined by fold line connections 33, 35 and 37 to rearward locations which terminate in front of backing panel segments 24, 26, 28 and 30. Slots 38, 40 are utilized to receive fiberboard shelf panels 20, 22 as hereinafter described.

The fiberboard shelf panels 20 and 22 are identical, and are formed from fiberboard blanks cut and scored as illustrated with respect to panel 20 in FIG. 6. Each of the shelf panels is formed from a pair of foldable panels 42, 44 separated along a scored fold line 43 of a fiberboard blank. Each of the foldable shelf panel segments 42 and 44 is slotted along its outer edge as indicated by slots 42*a*, 42*b* and 42*c* with respect to panel segment 42. Slots 44*a*, 44*b* and 44*c* are cut in the outer edge of shelf panel segment 44. The opposed slots in the two shelf panel segments 42 and 44 are in alignment with each other as shown in FIG. 6. The shelf panels are scored at locations inwardly from the end extremities thereof along fold lines 46 and 48 which extend all of the way across shelf panel segments 42 and 44. When panel segments 42 and 44 are folded over in face to face relation along scored fold line 43, they provide a horizontal shelf panel of double thickness as shown in FIG. 5. The double wall end segments of each horizontal shelf panel 20 and 22 comprise foldable locking segments 47, 49 defined by fold line connections 46, 48 with shelf panel segments 42 and 44. Scored fold lines 46 and 48 are provided at predetermined locations along the length of the shelf panels 20 and 22 so that locking segments 47 and 49 can be folded inwardly to positions wherein the entire length of the divider insert 16 will be less than the length of the opening between front corner posts 2 and 8 for insertion therebetween. Locking segments 47 and 49 are scored transversely across their outer ends to define foldable end support flaps 50 and 52. These flaps are folded to vertical support positions after the divider unit 16 is installed between shelves of shelf unit 1.

Shelf panels 20 and 22 are first folded to the double thickness indicated in FIG. 5 by folding panel segments 42 and 44 together along fold line connection 43. When this is done, slot 42*a*, 42*b* and 42*c* will be in alignment with slots 44*a*, 44*b* and 44*c* respectively so as to define continuous slot openings along the inner edge of each of the shelf panels 20 and 22. These continuous slot openings are aligned with slots 38 and 40 with the shelf panels in horizontal positions as indicated in FIG. 5. The shelf panels are then mounted on upright support panel 18 by sliding these slot openings inwardly over the leading edges of the shelf support segments defined by fold lines 33, 35 and 37. With the shelf panels 20 and 22 inserted through the slots 38 and 40 to positions abutting upright support panel 18, the shelf slots on the inner edge thereof will be in frictional engagement with the rear faces of shelf support segments 32*a*, 32*b*, 34*a*, 34*b* and 36*a*, 36*b*. FIG. 2 shows the shelf panels 20 and 22 fully assembled to upright support panel 18 with locking segments 47, 49 horizontal and end support flaps 50 and 52 folded downwardly in their vertical support positions.

Figure 4:
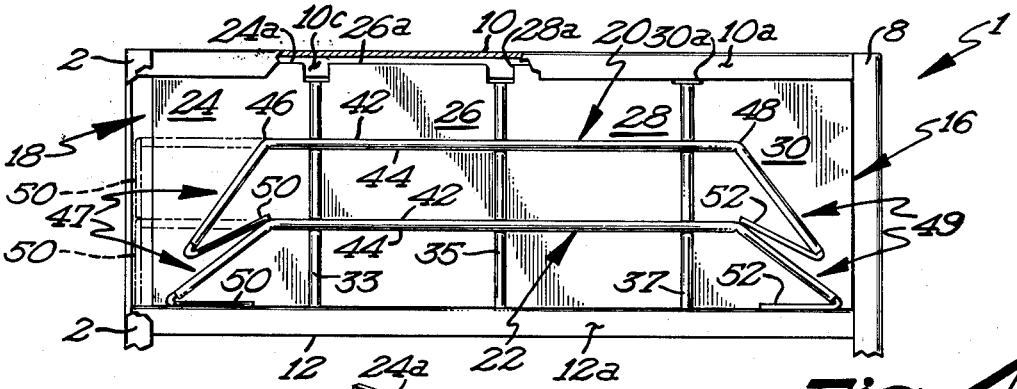
FIG. 4 is a front, elevation view of the shelf assembly of FIG. 1 showing the divider insert in an intermediate stage of installation for clearing the corner posts of the shelf unit.

In order to install divider insert 16 between shelves 10, 12 of shelf unit 1, end support flaps 50 and 52 are first folded inwardly along their fold line connections with locking panel segments 47 and 49 to positions thereunder as indicated in FIG. 4. With the divider insert 16 then aligned with the opening between a pair of rigid shelves 10 and 12, the locking segments 47 and 49 on opposite ends of the shelf panels 20, 22 are folded downwardly and inwardly to be inclined non-locking positions shown in FIG. 4. In this position of locking segments 47 and 49 their outer ends defined by the fold line connections with support flaps 50 and 52 would be disposed inwardly from the inside edges of the shelf unit corner posts 2, 4, 6 and 8. The installer grips the pairs of downwardly inclined locking segments 47, 49 in his hands, thereby pinching them together as the divider insert assembly 16 is inserted between shelves 10 and 12. The top edge of upright support panel 18 is tilted forwardly slightly during this installation process so that the divider unit is inserted at a slightly inclined position from the vertical. This ensures that the upper locking tabs 24*a*, 26*a*, 28*a* and 30*a* will clear the front flange 10*a* of top shelf 10. The divider unit is pushed all the way to the rear of the shelf unit 1 along bottom shelf 12 until the aforesaid lock tabs 26*a* – 30*a* abut against the inside face of rear flanges 10*c* of top shelf 10. This abutting engagement ensures that the divider unit will not be displaced out of the open rear side of the shelf unit 1. It is to be noted that upright support panel 18 is of a predetermined length less than the distance between the inside edges of the opposed front and rear pairs of shelf corner posts 2, 8 and 4, 6. This ensures that the support panel 18 will freely clear the corner posts as the divider unit is slidably positioned between a pair of shelves 10, 12.

After divider unit 18 has been pushed all the way in to the shelf unit 1 between a pair of shelves 10, 12, locking panel segments 47 and 49 are folded upwardly and outwardly along their fold line connections 46 and 48 with shelves 20 and 22 to substantially horizontal locking positions. In this locking position, the outer extremities of locking segments 47 and 49 extend behind the inwardly projecting front flange segments of front corner posts 2 and 8. This locking position of panel segments 47 and 49 is illustrated in phantom lines with respect to panel segments 47 in FIG. 4, and in solid lines in FIGS. 1 and 3. With the outer extremities of the locking segments 47 and 49 extending behind corner posts 2 and 8, the divider unit 16 is secured against displacement out of the open front end of shelf unit 1. After locking segments 47 and 49 have been folded outwardly to their horizontally extending locking positions, end support flaps 50 and 52 are folded outwardly to the substantially vertical support positions shown in phantom lines with respect to flaps 50 in FIG. 4, and in solid lines in FIG. 2. In this position, the bottom support flaps of the bottom shelf panel 22 rest on the bottom shelf 12. Support flaps 50 and 52 of the top fiberboard shelf panel 20 are in vertical alignment with the corresponding pair of support flaps on bottom shelf 22 and are supported thereon. In this manner, support flaps 50 and 52 serve to support end locking segments 47 and 49 of the shelf panels 20 and 22 in the substantially horizontal locking positions of use illustrated in FIGS. 1 and 2.

It is to be noted that the distance which score lines 46 and 48 are located inwardly from the outer end extremities of shelf panels 20 and 22 will depend upon the vertical distance between horizonal shelf panels 20 and 22 and between bottom shelf panel 22 and rigid support shelf 12. The shorter these vertical dimensions are between shelves, the closer to the end extremities of shelf panels 20 and 22 must score lines 46 and 48 be located. This will ensure that foldable locking segments 47 and 49 will be of such a length along the length of the horizontal shelf panels that when they are folded downwardly to the maximum extent permitted by the vertical spacing between shelves their outer end extremities will clear the inside edges of the shelf unit corner posts between which the divider unit is inserted.

FIGS. 8 – 11 illustrate a lateral file type of divider insert, and its manner of installation between the shelves of a rigid shelf unit. This lateral file type of divider unit is designated generally by reference numeral 54 and is comprised of an upright divider support member 56 in the form of a one piece fiberboard shell 56 and a plurality of fiberboard partitions 58. Shell 56 is U-shape and includes an upright back panel 60 interconnecting top and bottom panels 62 and 64. Shell 56 is open at its front end to receive fiberboard partitions 58 oriented in laterally spaced, vertical positions as shown.

Hingedly attached to the front edge of top panel 62 of shelf 56 along double score lines 68 are a plurality of lock flaps 66. Each of these lock flaps is preferably provided with at least one laterally projecting lock tab 70 at its outer end. One of such lock tabs is shown on one of the end lock flaps 66 in FIG. 8. A second series of lock flaps 72 are hingedly attached to the front edge of shell bottom panel 64 along score line connections 74 therewith. The opposing pairs of lock flaps 66 and 72 are in vertical alignment with each other, and serve to hold partitions 58 in restraining engagement with upright divider support shell 56 as set forth below. To this end, each of the bottom lock flaps 72 also has at least one laterally projecting lock tab 76 on its outer, free end.

Figure 8:
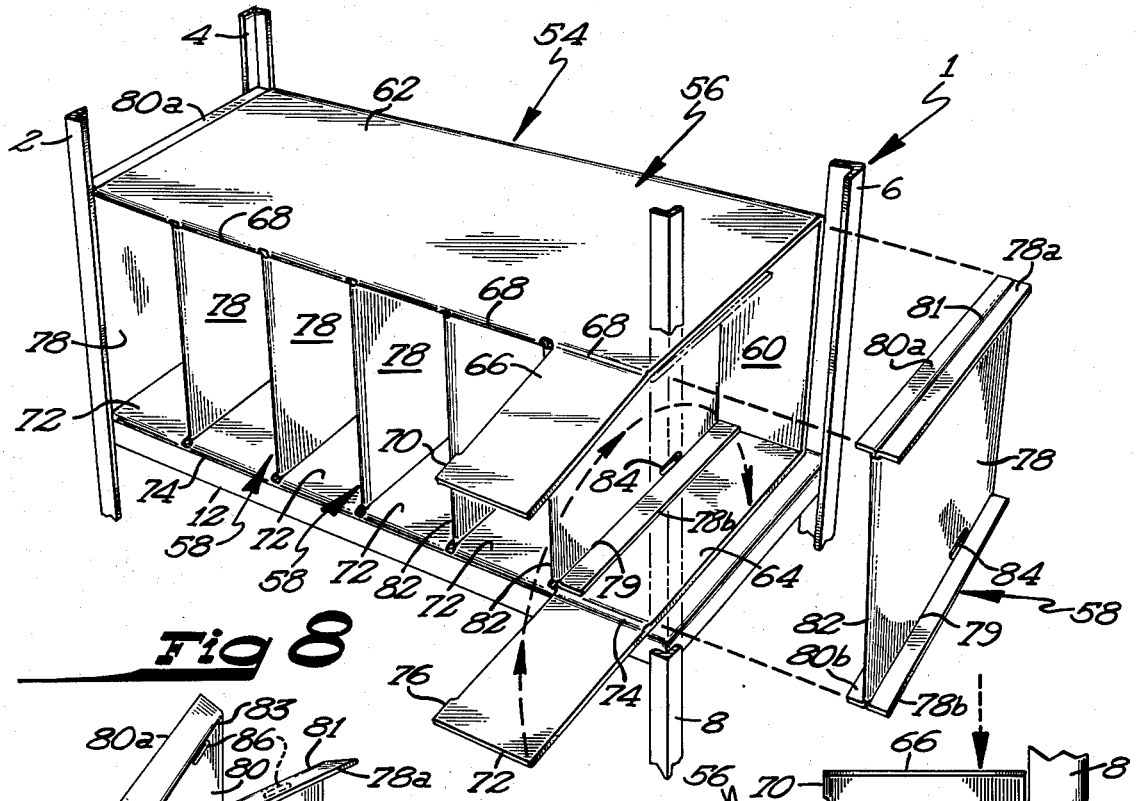
FIG. 8 is a front, perspective view, partially exploded, showing another form of a fiberboard divider insert in a shelf assembly.
Figure 9:
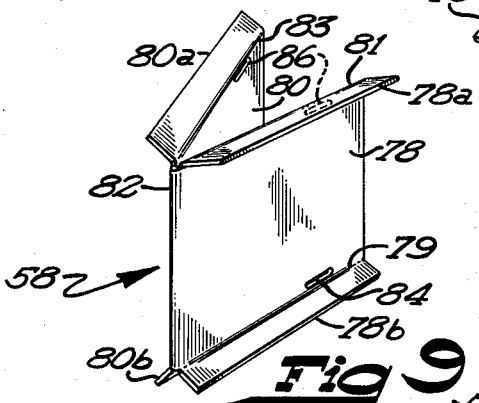
FIG. 9 is a perspective view of a partially folded, vertical partition for the divider insert of FIG. 8.

Each of the vertical partitions 58 is cut and scored from a single blank of fiberboard material. As may be most clearly understood by reference to FIG. 9, each of these vertical partitions is comprised of a pair of hinged, upright panels 78, 80 joined together along a hinge or fold line 82. Panels 78 and 80 are folded together in face to face engagement to form a vertical partition section of the dividers or partitions 58. Flange strips **78*a*, 78*b* and 80*a*, 80*b* are attached to the top and bottom ends of vertical panels 78, 80 of partitions 58 along fold line connections therewith. The fold line connections 79, 81 for flange strips 78*a*, 78*b* are shown in FIGS. 8 and 9. One of the fold line connections 83 for flange strips 80*a*, 80*b* of panel 80 is shown in FIG. 9. Each of the upright panels 78, 80 of partitions 58 is provided with slots 84 and 86 at its top and bottom ends respectively as shown in FIGS. 8 and 9. These slots receive the lock tabs 70 and 76 provided on the outer ends of lock flaps 66 and 72. When hinged panels 78 and 80 are folded together with their respective flange strips 78*a*, 78*b* and 80*a*, 80*b* folded to their horizontal extending positions of use, the partitions 58 assume an I-shape as shown with respect to the partition 58 in exploded view in FIG. 8**.

In assembling the divider unit 54, shell 56 is first folded to a generally upright position with back panel 60 upright, and top and bottom panels 62 and 64 projecting horizontally therefrom. At this stage, lock flaps 66 and 72 will be in forwardly extended open positions as shown with respect to one pair thereof in FIG. 8. The inside partitions or dividers 58 are placed on bottom panel 64 with their forward ends along fold lines 68 and 74. The bottom and top flaps 66 and 72 are then folded over the horizontally projecting flange strips **78*a*, 78*b* and 80*a*, 80*b* of each of the partitions 58. As the lock flaps 66 and 72 are folded into overlying, face to face positions with respect to top and bottom panels 62 and 64, their respective lock tabs 70 and 76 are engaged within aligned slots 84 and 86 on partition upright panels 78 and 80. In this manner vertical partitions 58 are locked in place in restraining engagement with top and bottom panels 62 and 64 in laterally spaced positions therebetween. Preferably, each of the lock flaps 66 and 72 has a pair of lock tabs 70 and 76 on its outer ends projecting from opposite sides thereof. Thus, there will be lock tabs engaged within the slots 84, 86 of both upright panels 78 and 80 of each divider or partition 58**.

Figure 10:
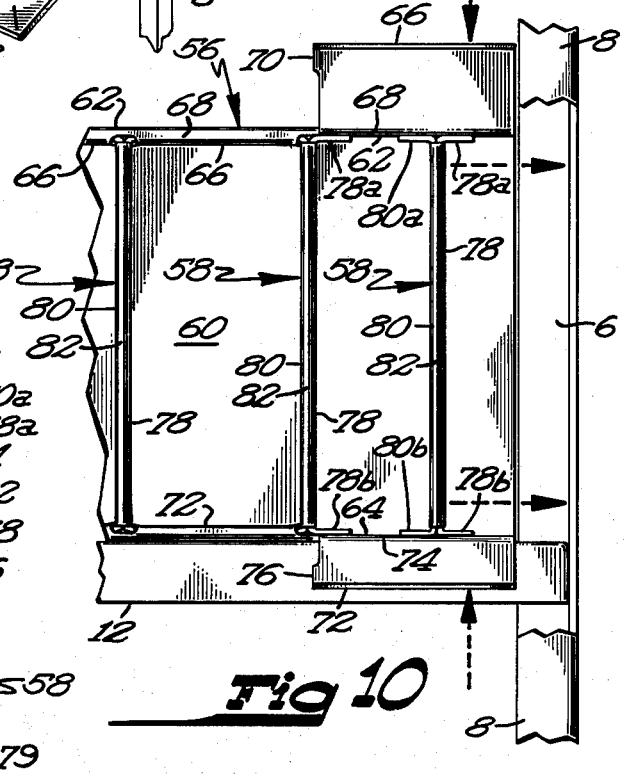
FIG. 10 is a fragmentary, front elevation view, partly broken away, of the shelf and divider insert assembly of FIG. 8.
Figure 11:
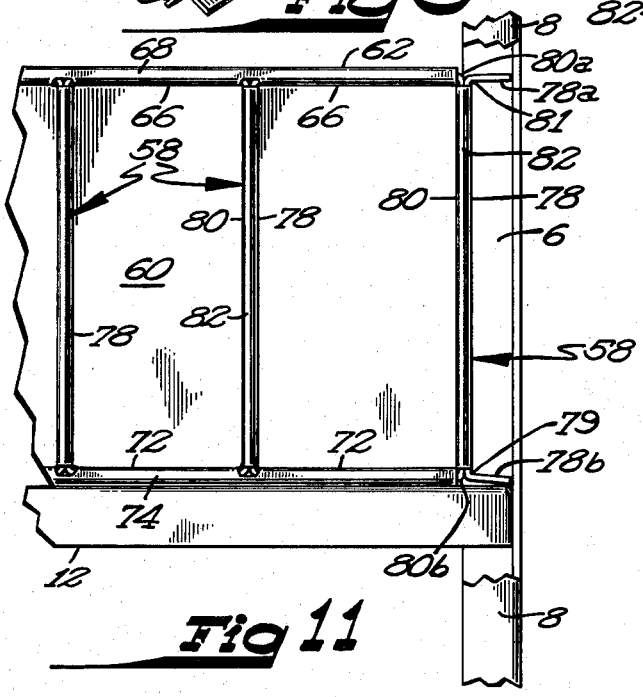
FIG. 11 is a front elevation view, similar to FIG. 10, and showing one of the end partitions moved to its non-locking position with respect to a corner post.

As the inside dividers are secured to shell 54 in the aforesaid manner, the pairs of opposed lock flaps 66, 72 on opposite ends of the shell 56 are left open and unfolded. The entire shell and partition assembly comprising divider unit 54 has been inserted between a pair of rigid shelves 10, 12 of a shelf unit 1 of the same construction illustrated in FIG. 1. For purposes of clarity, the top shelf 10 is not shown in FIG. 8, and divider unit 54 is shown in place on shelf unit 1, resting on a bottom shelf 12. The overall length of back panel 60, and top and bottom panels 62 and 64 is such that the divider assembly 54 will freely pass between the inside edges of front and back corner posts 2, 8 and 4, 6. After the divider unit 54 is in place between a pair of shelves 10, 12 and resting on bottom shelf 12, the end partitions 58 are slidably inserted between top and bottom panels 62 and 64 of divider unit 54. One of the end partitions 58 is shown in this intermediate position of installation in FIG. 10. The end partition as shown in FIG. 10 is then slidably moved to the right along the length of divider unit 54 to a position behind corner posts 8 and 1. In this locking position of the end partition 58, its outwardly projecting flange strips **78*a* and 78*b* will be positioned behind and inside of the vertically extending segments of corner posts 8 and 1 which project inwardly across the front face of the shelf unit. FIG. 11 shows the right end partition 58 in this final, locking position wherein its outwardly projecting flange strips 78*a* and 78*b* serve as locking segments behind corner posts 8 and 1 to prevent the displacement of the entire divider unit 54 out of the front or rear side of the shelf unit 1. After the end partition 58 has been so positioned, lock flaps 66 and 72 are folded in over inwardly projecting horizontal flange strips 80*a* and 80*b* of the end partition 58 as indicated by the directional arrow for lock flap 72 in FIG. 8. The inwardly folded flaps 66 and 72 on the right hand of divider unit 54 are locked in their retention positions overlying the inwardly projecting flange strips 80***a* and 80*b* in face to face relation with top and bottom panels 62 and 64 by means of their respective lock tabs 70 and 76. These lock tabs are engaged in the aligned slots 86 and 84 of the next partition 58 to the inside of the right end partition. The same steps are repeated in positioning and securing the left end partition 58 in a locking position behind the opposite corner posts 2 and 4.

It is to be noted that the inwardly projecting horizontal flange strips 80*a*, 80*b* on the end partitions 58 and the cooperating end lock flaps 66 and 72 on shell 56 serve as retainer means releasably securing the end partitions to the top and bottom panels 62, 64 of divider insert 54. With the outwardly projecting horizontal flange strips 78*a* and 78*b* of the end partitions 58 engaged behind the shelf unit corner posts 2, 4, 6 and 8, the restraining engagement of these end partitions 58 with the top and bottom panels 62 and 64 of the divider unit 54 will prevent the displacement of the entire divider unit out of the front and rear side of the shelf unit 1. The opening of the end flaps 66 and 72 permits the shifting of the end partitions 58 inwardly along the length of top and bottom panels 62 and 64 to non-locking positions wherein their outer flange strips 78*a* and 78*b* are moved out from behind the corner posts of the shelf unit to permit the removal of the divider unit from the rigid shelves.

In the version of the lateral file type of divider insert shown in FIG. 8, the dividers 58 are sized to extend over the entire width of top and bottom panels 62 and 64 to upright back panel 60. Thus, the rear ends of the outwardly extending, locking flange strips of the end partitions 58 will bear against the inwardly projecting flanges of the rear corner posts 1 and 4 so as to secure the divider unit 54 against displacement out of the rear side of shelf unit 1. Upright partitions or dividers 58 will be of uniform size and shape. Accordingly, it is anticipated that on some shelf assemblies having deeper shelves and divider inserts, partitions 58 will not extend all of the way from the front edge of shell 56 to back panel 60 thereof. For such applications, stop tabs cut from top panel 62 and forming upright extensions of back panel 60 will be utilized to engage the vertically extending, rear flange 10*c* of top shelf 10 in the same manner as tabs 24*a*, 26*a*, 28*a* and 30*a* of the divider insert 16 to prevent displacement of the divider insert out of the rear side of shelf unit 1.

I anticipate that various other changes may be made in the size, shape, construction and manner of installation of the divider units disclosed herein, in combination with a rigid shelf unit, without departing from the spirit and scope of my invention as defined by the following claims.

I claim:

1. A shelf and divider assembly comprising:

a shelf unit comprised of rigid, upright end support means spaced apart a predetermined shelf length and a plurality of rigid shelves secured therebetween in vertically spaced relation, each of said end support means having a vertically extending front segment projecting inwardly across the front face of said shelf unit beyond the end extremities thereof;

a divider unit removably positioned between a pair of said rigid shelves and resting on one of said shelves, said divider unit being comprised of an upright divider support member and a plurality of fiberboard partitions restrainably engaged therewith; and at least on locking segment on one of said partitions at each end of said divider unit in a locking position behind said vertically extending front segments of said end support means to restrain said divider unit against forward movement of said shelf unit, said locking segments being movable inwardly from said end support means out from behind said vertically extending front segments thereof to non-locking positions wherein said divider unit may be freely inserted between and removed from said rigid shelves of said shelf unit without interference with said end support means.

2. A shelf and divider assembly as defined in claim 1 wherein:

lock tabs project upwardly from the top of the rear side of said upright divider support member and bear against the inside face of a depending contact surface on the rear edge of the top shelf of said pair of rigid shelves to thereby prevent displacement of said divider unit out of the rear side of said shelf unit.

3. A shelf and divider assembly as defined in claim 2 wherein:

said rigid shelves include a vertially depending, elongated flange along at least the rear edges thereof defining said depending contact surface;

said divider support member includes an upright panel disposed in substantial alignment with the rear edges of said rigid shelves when said divider unit is in its position of use on said shelf unit; and said lock tabs project upwardly from the top of said upright panel.

4. A shelf and divider assembly as defined in claim 1 wherein:

said divider support member is in the form of an upright fiberboard panel and said fiberboard partitions are in the form of vertically spaced, horizontal shelf panels mounted on said upright panel; and said locking segments comprise end segments on the opposite ends of said shelf panels defined by scored fold lines located inwardly from the end extremities thereof, said scored fold lines being so located along the length of said horizontal shelf panels that said end locking segments can be folded downwardly to an inclined, non-locking position wherein the outer ends thereof are disposed inwardly along the length of said horizontal shelf panels from said vertically extending front segments of said end support means for removable insertion therebetween, after which said end locking segments are folded upwardly to said locking positions behind said vertically extending front segments of said end support means.

5. A shelf and divider assembly as defined in claim 4 wherein:

said end locking segments are scored transversely across their outer ends to define foldable end support flaps on the ends of each of said horizontal shelf panels which are oriented generally vertically one one top of the other and on top of said rigid shelves and support said locking segments in substantially horizontal locking positions, and said support flaps being foldable inardly along said transverse score lines under said end locking segments to permit the movement of said divider unit in and out of its position of use between said rigid shelves with said transverse score lines defining the end extremities of said end locking segments and being positioned inwardly from said end support means of said shelf unit for free movement therebetween when said end locking segments are in said inclined, non-locking positions with said support flaps folded thereunder.

6. A shelf and divider assembly as defined in claim 4 wherein:

said end support means of said shelf unit comprises four corner posts between which said rigid shelves are supported, said corner posts having vertical flanges comprising said vertically extending front segments of said end support means.

7. A shelf and divider assembly as defined in claim 4 wherein:

said upright fiberboard panel is of a predetermined length less than the distance between the inside edges of said vertically extending front segments of said end support means for free movement therebetween as said divider unit is being inserted between or withdrawn from said rigid shelves.

8. A shelf and divider assembly as defined in claim 1 wherein:

said divider support member comprises a U-shaped fiberboard shell open at its front end and having an upright back panel interconnecting top and bottom panels;

said fiberboard partitions are laterally spaced, vertical partitions, at least the end ones of which are removably secured in place to said top and bottom panels in restraining engagement therewith;

said locking segments comprise substantially horizontal flange strips on the top and bottom of said removable fiberboard end partitions which project behind said vertically extending front segments of said end support means in said locking position thereof; and retainer means releasably securing said end partitions to said top and bottom panels, the releasing of said retainer means permitting the shifting of said end partitions inwardly along the length of said top and bottom panels to non-locking positions wherein said flange strips are moved out from behind said vertically extending front segments of said end support means to permit the removal of said divider unit from said rigid shelves.

9. A shelf and divider assembly as defined in claim 8 wherein:

said removable end partitions are I-shaped and comprise a vertical partition section and horizontal flange strips projecting inwardly and outwardly of said shell along the length thereof from the top and bottom ends of said vertical partition section, the outwardly projecting flange strips comprising said locking segments.

10. A shelf and divider assembly as defined in claim 9 wherein:

lock flaps are hingedly attached to the front edges of said top and bottom panels of said shell and are foldable from open positions to retention positions overlying said inwardly projecting flange strips in face to face relation with said top and bottom panels, whereby said lock flaps and said inwardly projecting flange strips serve as retainer means releasably securing said end partitions to said top and bottom panels.

* * * * *

UNITED STATES PATENT AND TRADEMARK OFFICE

CERTIFICATE OF CORRECTION

PATENT NO. : 4,062,302

DATED : December 13, 1977

INVENTOR(S) : Bradford J. Krizan

It is certified that error appears in the above-identified patent and that said Letters Patent are hereby corrected as shown below:

Column 8, line 3, change "on" before "locking segment" to --one--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*